US006808479B2

(12) United States Patent
Trovinger et al.

(10) Patent No.: US 6,808,479 B2
(45) **Date of Patent: *Oct. 26, 2004**

(54) THICK MEDIA FOLDING METHOD

(75) Inventors: Steven W. Trovinger, Los Altos, CA (US); Ross R. Allen, Belmont, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 204 days.

This patent is subject to a terminal disclaimer.

(21) Appl. No.: 09/970,748

(22) Filed: Oct. 5, 2001

(65) Prior Publication Data

US 2003/0069117 A1 Apr. 10, 2003

(51) Int. Cl.[7] ..... B31F 7/00
(52) U.S. Cl. ..... 493/442; 493/476
(58) Field of Search ..... 493/395, 405, 493/416, 432, 444, 438, 445, 476, 434, 442, 475; 492/39, 40, 42; 83/501, 502

(56) References Cited

U.S. PATENT DOCUMENTS

| | | | | |
|---|---|---|---|---|
| 3,202,066 | A | 8/1965 | Palmer | |
| 3,398,661 | A | 8/1968 | Mathes et al. | |
| 3,434,399 | A | 3/1969 | Palmer | |
| 3,854,361 | A | * 12/1974 | Kercher et al. | 83/499 |
| 3,916,749 | A | 11/1975 | Armelin | |
| 3,978,773 | A | 9/1976 | Pinto | |
| 3,995,849 | A | 12/1976 | Kistner | |
| 4,015,838 | A | 4/1977 | Thurmann | |
| 4,041,849 | A | 8/1977 | Tsukasaki | |
| 4,053,150 | A | 10/1977 | Lane | |
| 4,101,121 | A | 7/1978 | Rastorguyeff | |
| 4,221,373 | A | 9/1980 | Muller Hans | |
| 4,226,410 | A | 10/1980 | McIntosh, Sr. et al. | |

(List continued on next page.)

FOREIGN PATENT DOCUMENTS

| | | |
|---|---|---|
| DE | 1231723 | 1/1967 |
| DE | 4018709 | 1/1981 |
| EP | 0038942 | 11/1981 |
| WO | WO 00/18583 | 4/2000 |

OTHER PUBLICATIONS

Steven W. Trovinger et al., U.S. patent application No. 09/970,730 filed Oct. 5, 2001, entitled "Sheet Folding Apparatus".

Steven W. Trovinger, U.S. patent application No. 10/259,458 filed Sep. 30, 2002, entitled "Method and Apparatus for Sheeting Folding".

*Primary Examiner*—Rinaldi I. Rada
*Assistant Examiner*—John Paradiso

(57) ABSTRACT

A system for folding sheet material, including a fold blade, two fold rollers biased away from each other, an adjusting member which alters a distance between the two fold rollers, and first drive means for moving at least one of the fold blade and the two fold rollers along a first path to position the fold blade between the two fold rollers.

19 Claims, 5 Drawing Sheets

U.S. PATENT DOCUMENTS 4,265,437 A 5/1981 Reist et al.
4,310,326 A 1/1982 Bellanca
4,496,339 A 1/1985 Moll
4,557,714 A 12/1985 Sabelstrom et al.
4,559,855 A * 12/1985 Schieck ..... 83/425.3
4,571,237 A * 2/1986 Vogtlander ..... 493/416
4,595,187 A 6/1986 Bober
4,614,512 A 9/1986 Capdeboscq
4,643,058 A * 2/1987 Zingler et al. ..... 83/23
4,643,705 A 2/1987 Bober
4,834,696 A 5/1989 Marschke
4,891,681 A 1/1990 Fiske et al.
4,893,803 A 1/1990 Petersen
5,028,193 A 7/1991 Misicka
5,080,339 A 1/1992 Hirahara
5,087,163 A 2/1992 Erdbories et al.
5,092,827 A 3/1992 McAdam, III et al.
5,114,392 A 5/1992 McAdam, III et al.
5,147,276 A 9/1992 Stab
5,169,376 A 12/1992 Ries et al.
5,190,514 A 3/1993 Galvanauskas
5,230,686 A 7/1993 McAdam, III et al.
5,242,364 A 9/1993 Lehmann
5,346,350 A 9/1994 Luhman et al.
5,377,965 A 1/1995 Mandel et al.
5,452,920 A 9/1995 Parker
5,465,213 A 11/1995 Ross
5,738,620 A 4/1998 Ebner et al.
5,803,891 A 9/1998 Haan et al.
5,937,757 A 8/1999 Jackson et al.
5,979,348 A 11/1999 Yaguchi
5,997,459 A 12/1999 Kruger et al.
6,074,332 A * 6/2000 Helmstadter et al. ..... 493/254
6,090,032 A 7/2000 Bellanca
6,094,225 A 7/2000 Han
6,120,427 A 9/2000 Haan et al.
6,193,458 B1 2/2001 Marsh
6,363,851 B1 4/2002 Gerhard et al.
2003/0069118 A1 4/2003 Trovinger et al.
2003/0069119 A1 4/2003 Trovinger et al.
2003/0069121 A1 4/2003 Trovinger et al.

* cited by examiner

THICK MEDIA FOLDING METHOD

BACKGROUND OF THE INVENTION

1. Field of the Invention

The present invention relates generally to processing sheet material and, more particularly, to a sheet folding apparatus using two fold rollers that are biased away from another and an adjusting member to alter the distance between the fold rollers.

2. Background Information

Several systems for folding material are known in the art where the characteristics of particular folding components are adjustable. For instance, self-adjusting components are included in the system described in U.S. Pat. No. 5,738,620 (Ebner et al.), the disclosure of which is hereby incorporated in its entirety. In the Ebner patent, a stack of sheets is pushed between a pair of pre-folding rollers and a pair of folding rollers by a folding knife. One half of each roller pair is spring-loaded towards and pivots away from the other half when a stack of sheets is introduced by the folding knife. While such a system allows for some automatic adjustment, much force is needed to force a stack of sheets (i.e., made up of more than one sheet) between the rollers. Also, the Ebner patent may not be able to produce sharply defined folds, as the roller pairs may not be equipped with enough spring force to do so.

A system for finishing printed sheets into booklets is described in PCT Document No. WO 00/18583 (Trovinger et al.). The Trovinger PCT includes an operation where individual booklet sheets are folded using two drive motor assemblies. A first vertical drive motor assembly operates to immobilize a sheet by pressing it against a fold blade with a folder assembly. This first vertical drive motor assembly moves a set of fold rollers into contact with both the sheet and a longitudinal fold blade. The axes of rotation for the fold rollers are perpendicular to the fold blade used to fold each sheet. A second horizontal drive motor then operates to deform the sheet against the fold blade by reciprocating the set of fold rollers, which have been placed into contact with the sheet, back and forth along the fold blade to in effect crease the sheet. The number and spacing of these rollers are such that during horizontal movement of the fold rollers, at least one fold roller passes over every point along the portion of a sheet where a fold is to be formed.

The Trovinger PCT also describes the use of self-adjusting, v-shaped fold rollers, each of which include two complementary disks that are spring-loaded towards each other on a common axle. However, rollers of this configuration may not be able to produce a sharply defined fold, as described above with respect to the Ebner patent.

It would be desirable to provide for precise folding of a wide range of sheet materials where a distance between fold rollers can be easily selected and rigidly fixed.

SUMMARY OF THE INVENTION

Accordingly, the present invention is directed to an apparatus that folds sheet material by adjusting a distance between two fold rollers biased away from each other with an adjusting member and by positioning a fold blade between the fold rollers. In this way, variable media thickness can be accommodated while producing sharp folds.

According to one embodiment of the present invention, a system for folding sheet material is provided, including a fold blade, two fold rollers biased away from each other, an adjusting member which alters a distance between the two fold rollers, and first drive means for moving at least one of the fold blade and the two fold rollers along a first path to position the fold blade between the two fold rollers.

According to another embodiment of the present invention, a method for folding a sheet of material is provided, including the steps of feeding a sheet material into an area between two fold rollers and a fold blade, adjusting a distance between the two fold rollers, wherein the two fold rollers are biased away from each other, and moving the two fold rollers and the fold blade relative to one another to form a fold in the sheet using the fold blade.

BRIEF DESCRIPTION OF THE DRAWINGS

Other objects and advantages of the present invention will become more apparent from the following detailed description of preferred embodiments, when read in conjunction with the accompanying drawings wherein like elements have been represented by like reference numerals and wherein.

DETAILED DESCRIPTION OF THE INVENTION

Figure 1A:
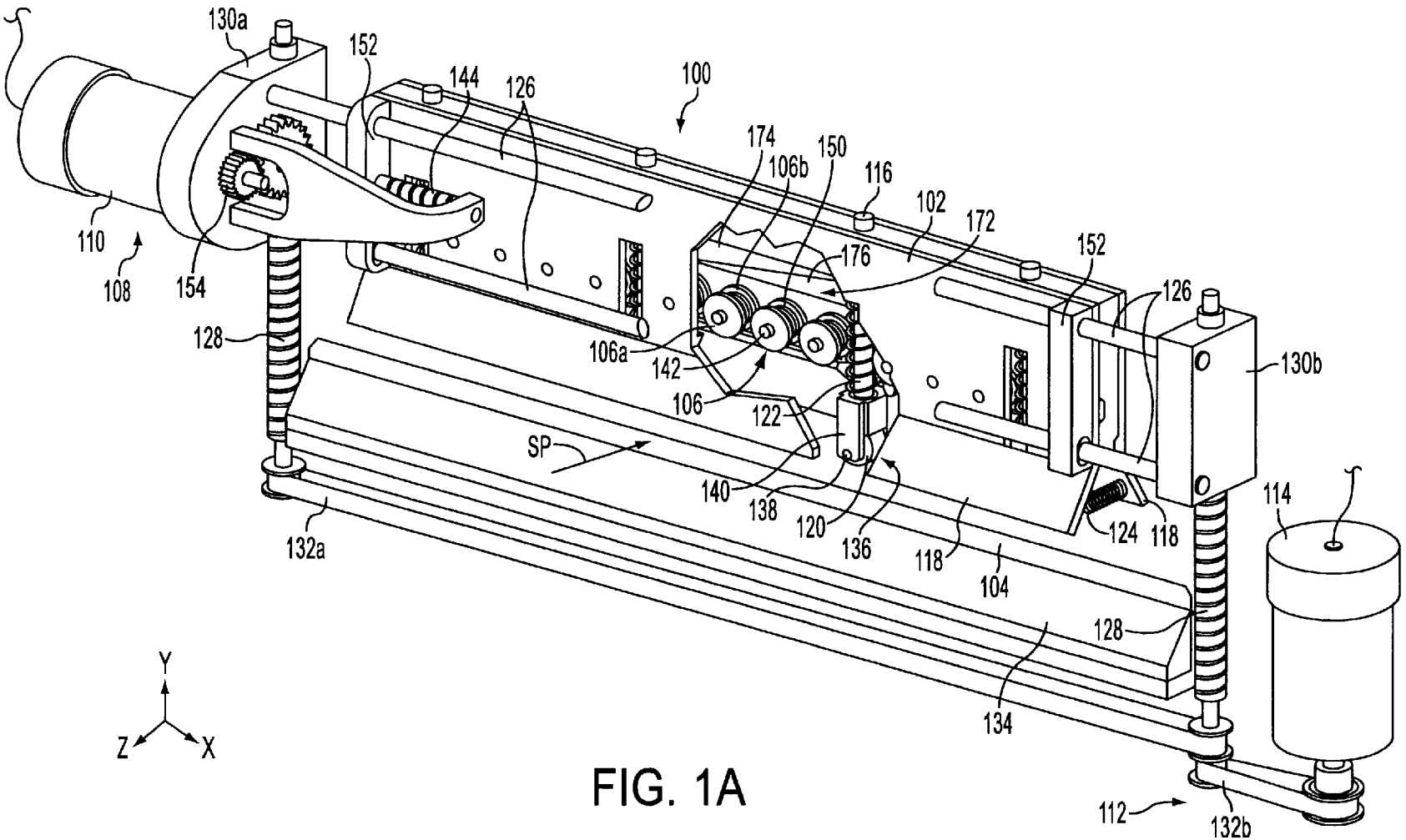
FIGS. 1A and 1B illustrate perspective views of a folding apparatus in accordance with an exemplary embodiment of the present invention.
Figure 1B:
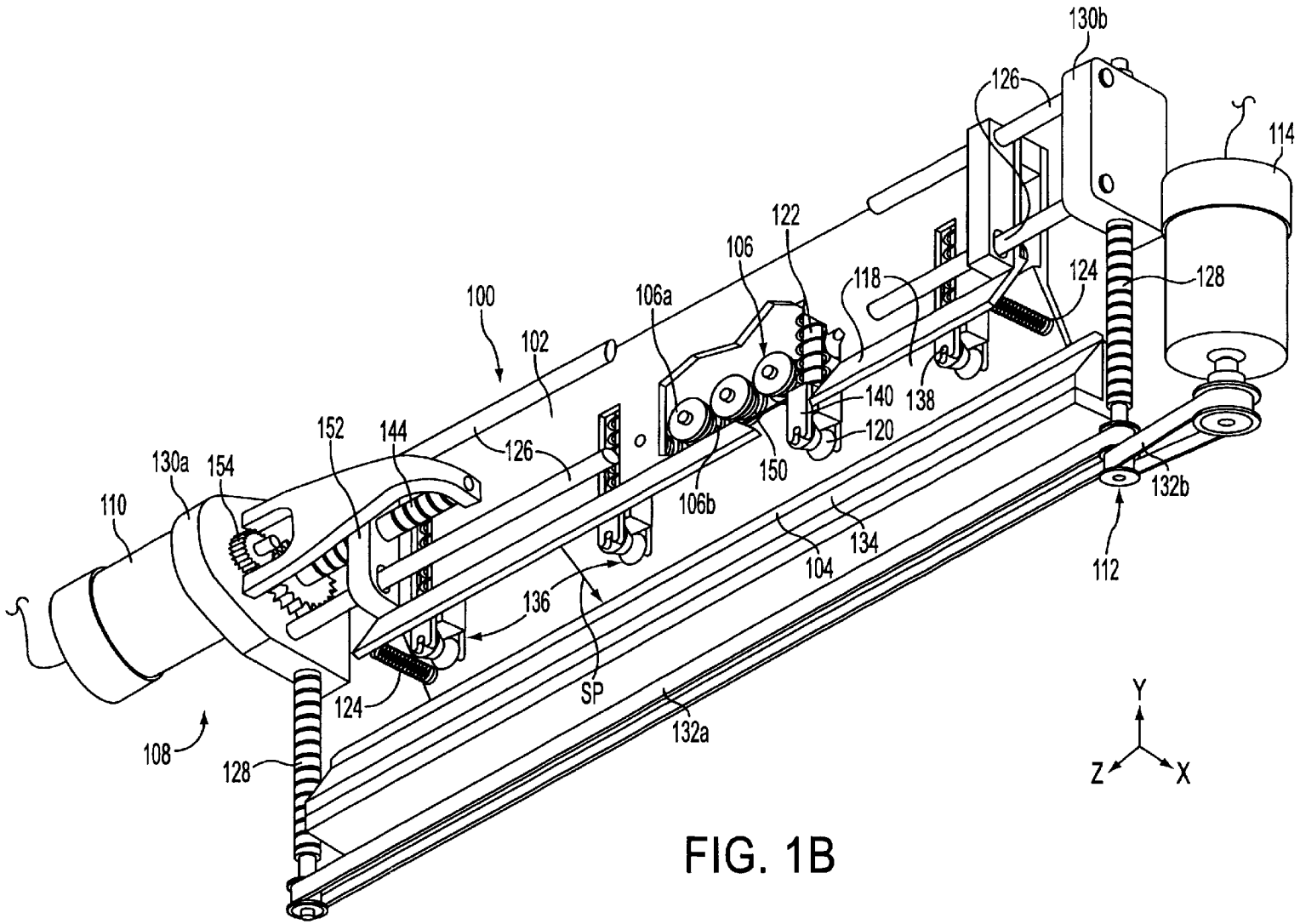

A system for folding sheet material is represented as folding apparatus 100 in FIGS. 1A and 1B. The exemplary folding apparatus 100 includes a fold blade, such as fold blade 104 having a longitudinal axis along the x-axis of FIG. 1A. Fold blade 104 is shown to be held by a blade holder 134, but can alternatively be held by any other stabilizing structure or can be manufactured with blade holder 134 as a unitary component. Fold blade 104 can be fixed or can alternatively be movable (for example, along rails 128 in the y-axis of FIG. 1A, or along any desired axis). Fold blade 104 can be made of metal (such as stainless steel) or any other formable material, and can be shaped as a flat strip or can include a rounded shape, these example being non-limiting, of course.

Figure 2B:
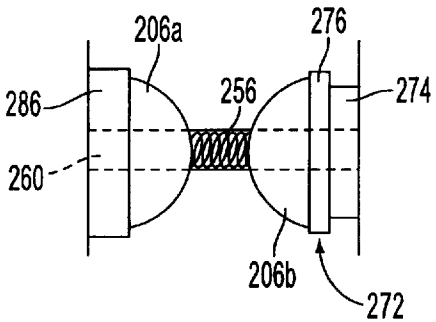
FIGS. 2A and 2B illustrate a frontal view of components of a folding apparatus in accordance with the embodiment shown in FIGS. 1A and 1B.
Figure 2A:
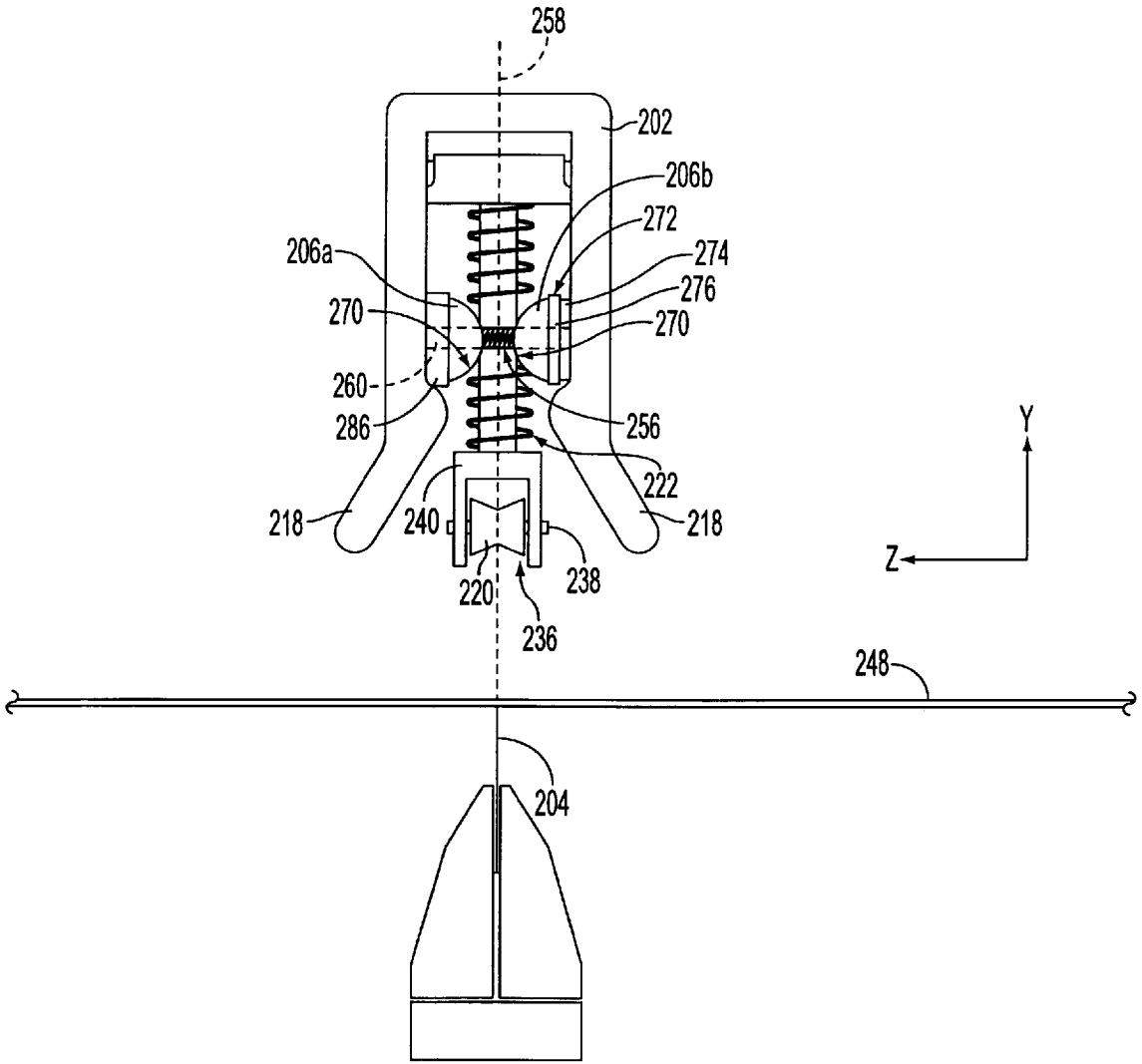

Folding apparatus 100 also includes two fold rollers biased away from each other, such as fold rollers 106*a* and 106*b*. In the embodiment shown in FIGS. 1A and 1B, fold rollers 106*a* and 106*b* operate together to form a grooved fold roller pair 106 and a fold groove 150. Folding apparatus 100 can include any number of roller pairs 106 (and therefore any number of fold rollers 106*a* and 106*b*). Rollers 106*a* and 106*b* rotate about an axis perpendicular to a longitudinal axis of fold blade 104 and, in the FIG. 1A example, this axis of rotation is along the z-axis and the longitudinal axis of fold blade 104 is along the x-axis. Rollers 106*a* and 106*b* can be made of metal or any other formable material, and can be coated with an elastomeric or deformable material such as an elastomer. Rollers 106*a* and 106*b* can be circular in cross-section (as shown in FIGS. 1A and 1B), or can alternatively have any other cross-sectional shape that can operate with fold blade 104 to create a fold in sheet material. A frontal view of housing 102 and rollers 106*a* and 106*b* is shown in FIGS. 2A and 2B, where these elements are represented by housing 202 and rollers 206*a* and 206*b*.

Figure 3A:
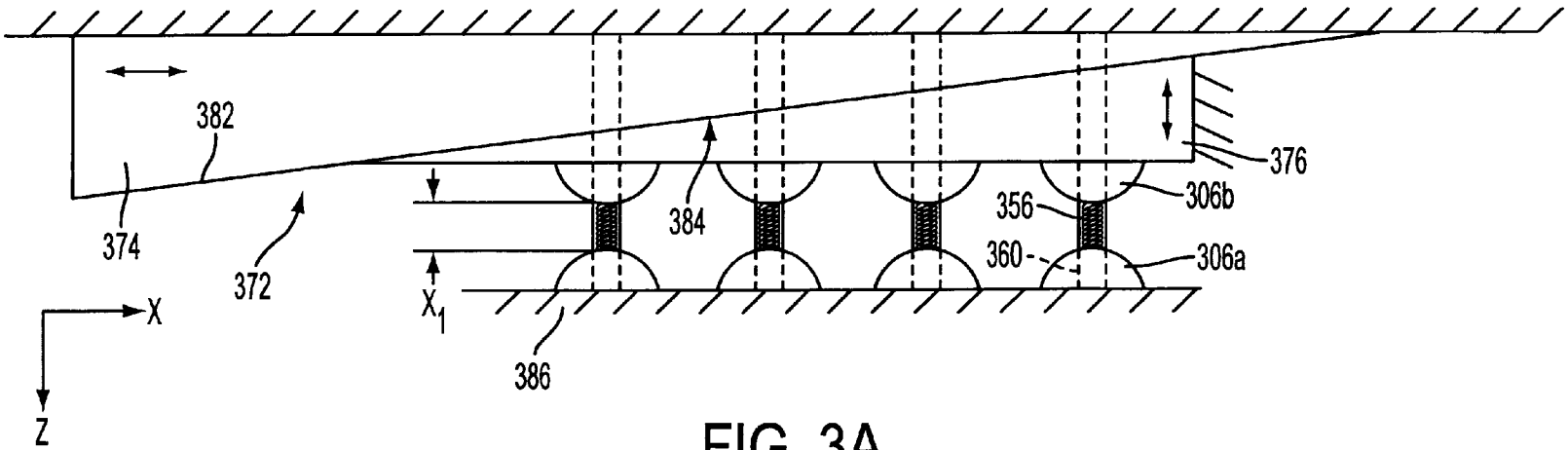
FIGS. 3A and 3B illustrate detailed views of the folding apparatus in accordance with the embodiment shown in FIGS. 2A and 2B.
Figure 3B:
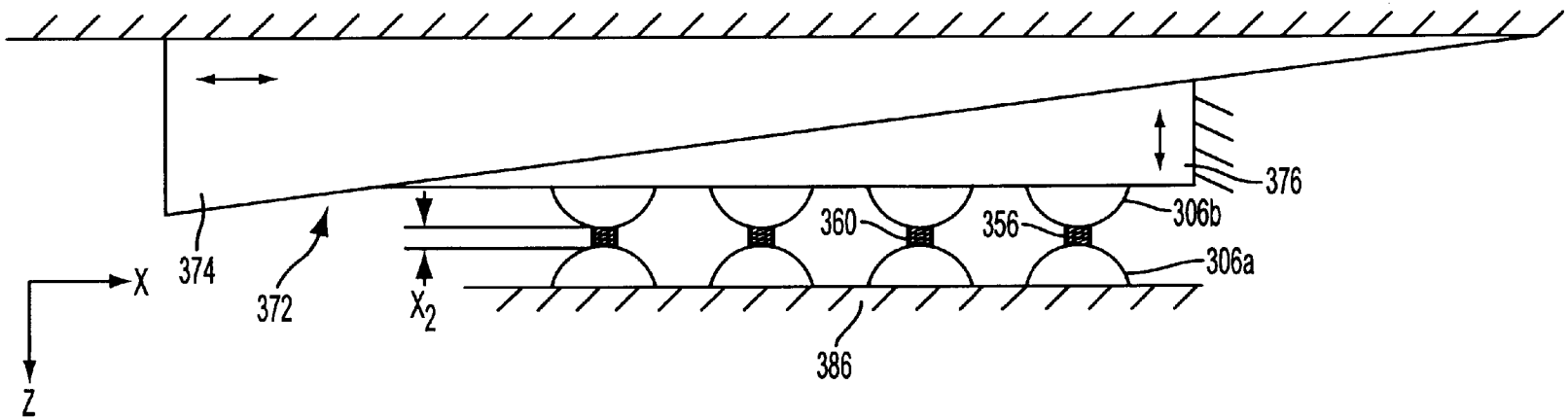
Figure 4:
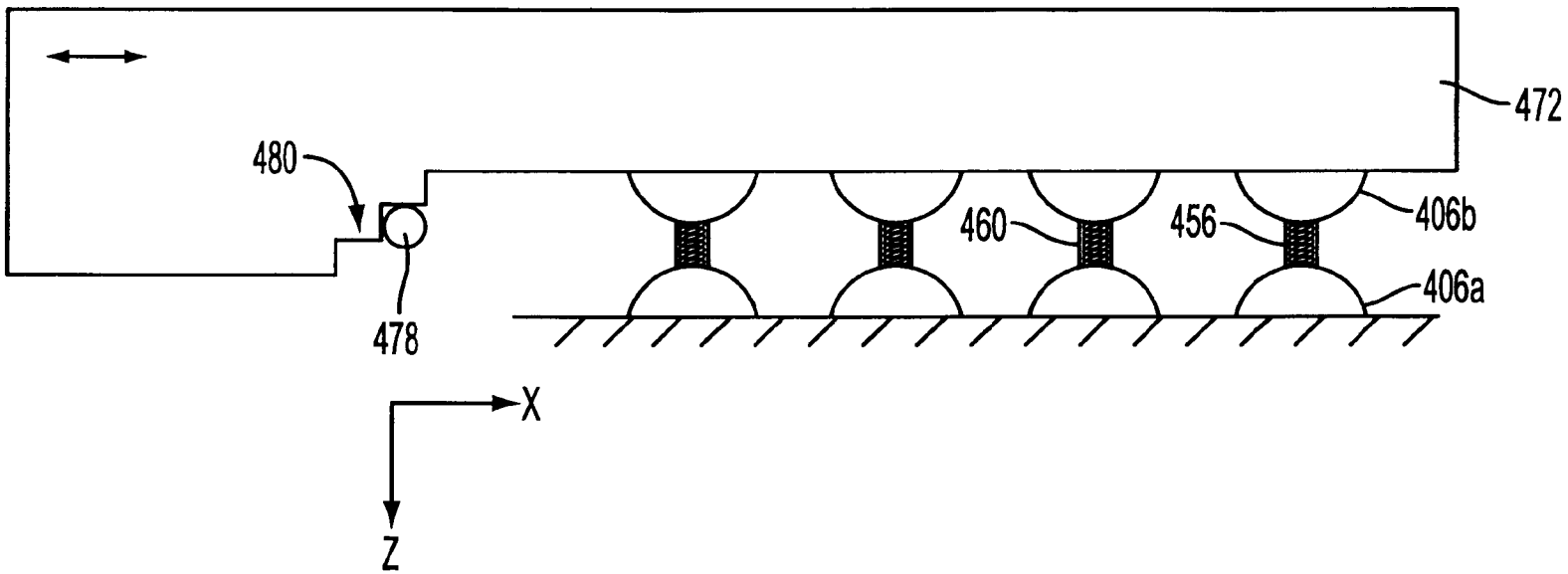
FIG. 4 illustrates a detailed view of a folding apparatus in accordance with another exemplary embodiment of the present invention.

Also provided is an adjusting member, such as adjusting member 172 in FIG. 1A, which alters a distance between the two fold rollers. In the FIG. 1A example, adjusting member 172 includes first and second inclined components, numbered 174 and 176, respectively. A single adjusting member 272 is shown to connected to fold roller 206*b* in corresponding FIGS. 2A and 2B, but, of course, adjusting member 272 can be alternatively connected to fold roller 206*a*. Also, both fold rollers 106*a* and 106*b* can be connected to two separate adjusting members similar to adjusting member 272. Adjusting member 172 is represented in FIGS. 3A and 3B as element 372, which includes inclined components 374 and 376. Alternatively, adjusting member 172 is represented in FIG. 4 as element 472, which includes a stepped surface 480 that interfaces with a pin 478. In all of the exemplary embodiments, adjusting member 272 can be made of metal, plastic, or any other formable material. Also, second inclined component 376 (and also adjusting member 472) can directly contact fold rollers 306*b* (and 406*b*), or can contact them indirectly by any conventional or other means that facilitate a relative sliding motion (e.g., smooth plastic separators).

A first drive means is provided for moving at least one of the fold blade and the two fold rollers along a first path to position the fold blade between the two fold rollers. In the exemplary embodiment shown in FIGS. 1A and 1B, the first drive means is represented by first drive assembly 112, which includes a lead screw (represented by one of lead screws 128), where a rotation of the lead screw in a first direction is operable to move the fold roller against the fold blade to create a fold in a sheet material. First drive assembly 112 also includes first motor 114 and belts 132*a* and 132*b*. First motor 114 can be of any conventional type (such as electric, pneumatic, or hydraulic), or can alternatively be of any other type. The exemplary lead screws 128 can be rotated by first motor 114 via drive belts 132*a* and 132*b* or alternatively by any other power transmitting element, such as a chain. Also, first drive assembly 112 can alternatively be formed as any other actuating system, such as, but not limited to, four-bar linkages, slider-crank mechanisms, pulleys and belts, rack and pinions, and linear actuators (e.g., soleniods, linear electric motors, and hydraulic or pneumatic cylinders).

As first motor 114 is driven by a power supply and controlled by, for example, a controller, lead screws 128 rotate and cause brackets 130 to move along the y-axis, the direction of their movement dependent on the direction of rotation of the lead screws 128. Housing 102 is connected to brackets 130*a* and 130*b* by rods 126 and thereby translates along the y-axis when first motor 114 is driven. Housing 102 has a longitudinal axis in the x-axis and can be made of any formable material, such as, but not limited to, metal or plastic.

Also provided in the exemplary folding apparatus 100 is a second drive means (such as second drive assembly 108) for moving the two fold rollers along a longitudinal axis of the fold blade. Second drive assembly 108 includes second motor 110 (mounted on bracket 130*a*), gear assembly 154, and lead screw 144. Second motor 110 can, of course, be alternatively mounted on bracket 130*b* or on another component. As with first motor 114, second motor 110 can be of any conventional type (such as electric, pneumatic, or hydraulic), or can be of any other type. The exemplary lead screw 144 can be rotated by second motor 110 via gear assembly 154 or alternatively by any other power transmitting element, such as a chain. Also, second drive assembly 108 can alternatively be formed as any other actuating system, such as, but not limited to, four-bar linkages, slider-crank mechanisms, pulleys and belts, rack and pinions, and linear actuators (e.g., soleniods, linear electric motors, and hydraulic or pneumatic cylinders). As second motor 110 is driven by a power supply and controlled by, for example, a controller, lead screw 144 rotates and causes housing 102 to move along rods 126 in the x-axis, with the direction of its movement (i.e., in the +x or −x direction) dependent on the direction of rotation of lead screw 144. As fold rollers 106*a* and 106*b* are rotatably mounted to housing 102 by roller axle 142, operation of second motor 110 moves fold rollers 106*a* and 106*b* along the longitudinal axis (i.e., the x-axis) of fold blade 104.

In the exemplary folding apparatus 100, the fold rollers 106*a* and 106*b* of each fold roller pair 106 are biased from each other by a spring, such as spring 256 shown in FIGS. 2A and 2B. Spring 256 is positioned within roller axle 260, which can be formed as a telescoping cylinder as in known in the art (e.g., as one component partially nested in the other). Spring 256 can therefore by positioned between the fold rollers 106*a* and 106*b* or can be located at any position along roller axle 260, as long as a biasing function is performed. Spring 256 (along with corresponding springs 356 and 456) can be a single spring, or can alternatively be of any number. Also, the spring rate of spring 256 can be within any range that allows relatively simple adjustment of adjusting member 272. Additionally, spring 256 can be in the form of a coil spring (as shown in FIGS. 2A and 2B) or can alternatively be formed as any other biasing means (e.g., a component including an elastic material such as rubber).

In the exemplary embodiment of FIGS. 2A and 2B, the two fold rollers 206*a* and 206*b* are rotatably mounted on a common roller axle, such as roller axle 260. As shown in FIG. 2A, roller axle 260 is attached at either end to housing 202, with spring 256 positioned within roller axle 260. Alternatively, each fold rollers 206*a* and 206*b* can be rotatably mounted on separate roller axles, e.g., on two concentric roller axles. Roller 206*a* can be positioned directly against an inner surface of housing 202, or can come in contact with a support 286 (as shown in FIGS. 2A and 2B), which can be useful for alignment purposes (e.g., centering of fold rollers 206*a* and 206*b*). Support 286 can be manufactured as an integrated part of housing 202 or can alternatively be formed as a detachable component.

As discussed above, each of fold rollers 206*a* and 206*b* operate as one half of a grooved fold roller pair 206, where each of fold rollers 206*a* and 206*b* has a folding profile 270 that is substantially hemispherical in shape. Alternatively, each folding profile 270 can be conical (such that grooved fold roller 206 assumes a v-shape in an initial or undisplaced state) or can be any other shape that can produce a fold in a sheet in conjunction with fold blade 204.

As shown in FIGS. 1A and 1B, housing 102 includes at least one pinch wheel, such as one of pinch wheels 120, for clamping sheet material against the fold blade, wherein the at least one pinch foot is elastically mounted to the housing. Each pinch wheel 120 is part of a pinch assembly 136, which includes a pinch bracket 140, a pinch axle 138, a pinch shaft 116, and a pinch spring 122. A pinch assembly corresponding to pinch assembly 136 is shown in FIG. 2A (in front view) as pinch assembly 236. Each pinch wheel 120 is rotatably attached to a pinch bracket 140 via a pinch axle 138, and each pinch bracket is attached to housing 102 via a pinch shaft 116 and pinch spring 122. Pinch shafts 116 permit vertical translation of pinch assemblies 136 during a folding operation. The FIG. 1B example shows four pinch assemblies 136, although this number can alternatively be greater or lesser.

Pinch wheels 120 are rotatable about pinch axles 138 and can be made of any formable material (metal and plastic being non-limiting examples) or of a deformable or elastomeric material. In the embodiment shown in FIGS. 1A and 1B, each pinch wheel 102 has a concave cylindrical contact surface, but this surface can also be a different shape (e.g., convex or flat). Pinch springs 122 can be linear, coil springs or can alternatively be any other elastic attaching means. Pinch wheels 120 are vertically biased by pinch springs 122 such that housing 102 can continue to translate towards fold blade 104 after pinch wheels 232 have engaged a sheet against fold blade 104, thereby anchoring it in place during a fold operation. Also, pinch assemblies 136 can alternatively include pinching components that are not rotatable and are not formed as wheels. For example, the clamping operation of pinch wheels 120 can instead be performed by a non-rotatable pinch foot with a v-shaped groove.

Housing 102 also includes fold flaps, such as two fold flaps 118, for forcing a sheet material around the fold blade. Fold flaps 118 can be arranged to have any angle between them such that blade holder 134 fits between fold flaps 118 during a folding operation. Fold flaps 118 can be manufactured with housing 102 as a unitary component or separately from housing 102, and can be manufactured from the same material as housing 102 or from a different, formable material. Fold flaps 118 can be pivotally attached to each other and can also be biased towards each other by using, for example, flap springs 124. Such an arrangement provides for the adjusting of the angle between fold flaps 118 to accommodate different sheet material thickness. Alternatively, any other elastic connecting means can be used to bias the fold flaps 118 towards one another, or fold flaps 118 can be fixedly attached to each other.

The folding operation of folding apparatus 100 includes a step of feeding a sheet material into an area between two fold rollers (such as fold rollers 206*a* and 206*b*) and a fold blade (such as one of fold blades 204). For example, in the FIG. 2A embodiment, sheet material 248 is advanced a predetermined distance in the +z or −z direction such that sheet material 248 is positioned between fold rollers 206*a* and 206*b* and fold blade 204. FIGS. 1A and 1B illustrate a sheet path SP of sheet material 248 in the −z direction, for example. The predetermined distance along the z-axis can be chosen by the desired width of the booklet and, for example, the location of the sheet in the booklet, as described in the Trovinger PCT. Sheet material 248 is positioned across fold blade 204 such that the location where a fold is desired is placed directly over the fold blade 204.

Another step provided in the folding method is the adjusting of a distance between the two fold rollers (e.g., fold rollers 206*a* and 206*b*), where the two fold rollers are biased away from each other (e.g., by spring 256). This step of adjusting includes a step of moving an adjusting member, such as adjusting member 272 of FIGS. 2A and 2B (corresponding to adjusting member 372 of FIGS. 3A and 3B) or adjusting member 472 of FIG. 4, where the adjusting member includes first and second inclined components (e.g., elements 374 and 376 in FIGS. 3A and 3B), where a movement of the first inclined component in a first direction (e.g., along the x-axis) causes a movement of the second inclined component in a second direction (e.g., along the z-axis), and wherein the first and second directions are perpendicular. Inclined components 374 and 376 can be made of metal, plastic, or any other formable material that can either 1) facilitate easy relative movement between the two components or 2) be at least partially covered by a material that allows such movement (e.g., by covering inclined surfaces 382 and 384 with a smooth polymer with low surface friction).

In FIGS. 3A and 3B, inclined component (or wedge) 374 is shown to be movable along a linear path in the x-axis while its movement is constrained in the z-axis (e.g., by an inner surface of housing 202, as illustrated in FIGS. 2A and 2B). Movement of inclined component 374 can also be constrained along the y-axis by support or guide members attached to an inner surface of housing 202 or formed on it. Inclined component 376 is shown in FIGS. 3A and 3B to be movable linearly along the z-axis while its movement is constrained along the x-axis (e.g., by a formation or an attachment on an inner surface of housing 202, as in known in the art). As with inclined component 374, movement of inclined component 376 can be constrained along the y-axis by support or guide members attached to an inner surface of housing 202 or formed on it.

Due to the shape of inclined components 374 and 376 (which respectively include inclined surfaces 382 and 384) and to the biasing force of springs 356, movement of inclined component 374 along the x-axis (either in the positive or negative direction) will result in a movement along the z-axis of inclined component 376. Inclined surfaces 382 and 384 can directly contact each other, or separate elements can be used to aid in providing the ability to easily slide inclined components 374 and 376 relative to each other. For example, roller bearings or similar components can be positioned between inclined components 374 and 376 for this purpose.

Fold rollers 306*b* are positioned to contact inclined component 376, and movement of inclined component 376 in the second direction (e.g., along the z-axis) alters a distance between fold rollers 306*a* and 306*b*. In the examples of FIGS. 3A and 3B, fold rollers 306*a* are rotatably mounted on roller axles 360, but are also constrained in their movement along the z-axis (i.e., by support 386). Fold rollers 306*b*, however, are allowed to both rotate about roller axles 360 and to move linearly along roller axles 360 (i.e., along the z-axis). In the FIG. 3A example, adjusting member 372 is positioned such that fold rollers 306*a* and 306*b* are separated by a distance of $x_1$ (e.g., representing one possible width of fold groove 150, shown in FIGS. 1A and 1B), in which case springs 356 are only partially compressed. Spring rates for springs 356 can be chosen such that they ensure contact between fold rollers 306*b* and inclined component 376, while also allowing relatively easy adjustment of adjusting member 372. In FIG. 3B, inclined component 374 is shown to be moved in the +x-direction such that fold rollers 306*a* and 306*b* are separated by a distance of $x_2$ (e.g., representing another width of fold groove 150), in which case springs 356 are fully compressed or nearly fully compressed. The difference between distances $x_1$ and $x_2$ can be from around 0 to 0.5 millimeters or can be greater, depending on the application.

Roller axles 360 can extend through adjusting members 372, in which case inclined components 374 and 376 can include slots or guides (oriented in the x-y plane) to allow their movement around roller axles 360. Alternatively, roller axles can extend in the −z-direction along partially through fold rollers 306*b*, without contacting or penetrating either component of adjusting member 372.

Inclined component 374 can be moved along the x-axis either manually by an operator, by an actuator controlled by a computer, or by any other conventional or other means. The positioning of inclined component 374 along the x-axis will depend on such factors as the type and thickness of sheet material that is to be folded. Once adjusted, inclined component 374 can be locked into positioned by any conventional or other means, such as set screws or quick-release levers, as are known in the art. In this way, an infinite number of distances between fold rollers 306*a* and 306*b* can be achieved and rigidly maintained to accommodate a wide range of sheet material thicknesses. Also, inner surfaces of housing 202 and/or support 386 can be adjustable to center fold rollers 306*a* and 306*b* over a fold blade (e.g., fold blade 104 or 204) when desired.

In the exemplary embodiment shown in the FIG. 4, adjusting member 472 is fashioned as a single-piece component with a stepped surface 480 that interfaces with a pin 478, which can be mounted on housing 202. In this example, adjusting member 472 can be moved in both the x-axis and z-axis such that the distances between fold rollers 406*a* and 406*b* can be discretely selected. Adjusting member 472 can be biased (e.g., by springs) in either or both the x-axis and the z-axis to secure its positioning. This configuration provides for the adjusting of distances between fold rollers 406*a* and 406*b* while ensuring that the distances are rigidly maintained to create a precise fold in sheet material.

The folding operation also includes a step of moving the two fold rollers and the fold blade relative to one another to form a fold in the sheet using the fold blade, where a first drive means (e.g., drive assembly 112) moves at least one of the fold blade and the two fold rollers to position the fold blade between the two fold rollers, and wherein a second drive means (e.g., drive assembly 108) moves the two fold rollers along a longitudinal axis of the fold blade. As shown in FIG. 2A, once sheet material 248 is positioned over the fold blade 204, housing 202 translates towards sheet material 248 and fold blade 204 in the -y direction through operation of first drive assembly 112 (FIGS. 1A and 1B). Pinch wheel 220 captures sheet material 248 against fold blade 204 by the force created by pinch springs 222 and, as housing 202 continues its advancement, pinch wheel 220 continues to maintain a securing force against sheet material 248 and fold blade 204 through the biasing action of the compressed pinch spring 222. A slack loop can be form in sheet material 248 by, for example, a paper drive assembly, as described in the Trovinger PCT.

Also during the above step, a second drive means (such as second drive means 108) moves the two fold rollers along a longitudinal axis of the fold blade. For example, after fold rollers 206*a* and 206*b* have been fully advanced around fold blade 204, housing 202 is moved transversely back and forth along the fold blade 204 by second drive assembly 108 to fully crease the sheet all along the length of the fold. Fold roller pairs 106 are spaced apart from each other and travel a horizontal distance sufficient to insure that every point along the edge of a fold is contacted and creased by at least one fold roller pair 106.

The above process can be repeated to fully crease sheet material 248 along the length of a fold. Once a fold is fully formed in sheet material 248, housing 202 is translated away from fold blade 204 to an initial position and, in so doing, pinch wheel 220 releases folded sheet material 248 from fold blade 204. Folded sheet material can then be ejected from folding apparatus 100 and delivered to a downstream device, such as a sheet-collecting saddle, for example.

Exemplary embodiments of the present invention can be modified to include features from any or all of the following copending applications, all filed on even date herewith, the disclosures of which are hereby incorporated by reference in their entirety: Sheet Folding Apparatus With Pivot Arm Fold Rollers, Attorney Docket No. 10001418; Sheet Folding Apparatus, Attorney Docket No. 10013280; Variable Media Thickness Folding Method, Attorney Docket No. 10013507; and Sheet Folding Apparatus With Rounded Fold Blade, Attorney Docket No. 10013506.

The exemplary embodiments of the present invention provide for the precise folding of a wide range of sheet material thicknesses and types. It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A method for folding a sheet of material, comprising the steps of:

feeding a sheet material into an area between two fold rollers and a fold blade;

adjusting a distance between the two fold rollers, wherein the two fold rollers are rotatably mounted on a common axis and are biased away from each other; and moving the two fold rollers and the fold blade relative to one another to form a fold in the sheet using the fold blade.

2. The method of claim 1, wherein a first drive means moves at least one of the fold blade and the two fold rollers to position the fold blade between the two fold rollers, and wherein a second drive means moves the two fold rollers along a longitudinal axis of the fold blade.

3. The method of claim 1, wherein the two fold rollers are biased away from each other by a spring.

4. The method of claim 1, wherein the common axis is perpendicular to a longitudinal axis of the fold blade.

5. The method of claim 1, wherein the step of adjusting includes the step of moving an adjusting member, the adjusting member comprising:

first and second inclined components, wherein a movement of the first inclined component in a first direction causes a movement of the second inclined component in a second direction, and wherein the first and second directions are perpendicular.

6. The method of claim 5, wherein the movement of the second inclined component in the second direction alters a distance between the two fold rollers.

7. The method of claim 1, wherein the step of adjusting includes the step of moving an adjusting member that includes a stepped surface.

8. The method of claim 1, wherein the common axis includes two concentric roller axles.

9. The method of claim 1, wherein the common axis is a common roller axle.

10. A system for folding sheet material, comprising:

a fold blade;

two fold rollers rotatably mounted on a common axis and are biased away from each other;

an adjusting member which alters a distance between the two fold rollers; and first drive means for moving at least one of the fold blade and the two fold rollers along a first path to position the fold blade between the two fold rollers.

11. The system of claim 10, comprising:

second drive means for moving the two fold rollers along a longitudinal axis of the fold blade.

12. The system of claim 10, wherein the two fold rollers are biased away from each other by a spring.

13. The system of claim 10, wherein the common axis is perpendicular to a longitudinal axis of the fold blade.

14. The system of claim 10, wherein each of the two fold rollers has a folding profile that is substantially hemispherical.

15. The system of claim 10, wherein the adjusting member comprises:

first and second inclined components, wherein a movement of the first inclined component in a first direction causes a movement of the second inclined component in a second direction, and wherein the first and second directions are perpendicular.

16. The system of claim 15, wherein the movement of the second inclined component in the second direction alters a distance between the two fold rollers.

17. The system of claim 10, wherein the adjusting member includes a stepped surface.

18. The system of claim 4, wherein the common axis includes two concentric roller axles.

19. The system of claim 10, wherein the common axis is a common roller axle.

* * * * *